US006926136B1

(12) United States Patent
Lynch-Bass

(10) Patent No.: US 6,926,136 B1
(45) Date of Patent: Aug. 9, 2005

(54) JEWELRY BOX

(76) Inventor: Sandra Lynch-Bass, 811 Highpoint Dr., Port Orange, FL (US) 32127

( * ) Notice: Subject to any disclaimer, the term of this patent is extended or adjusted under 35 U.S.C. 154(b) by 0 days.

(21) Appl. No.: 10/819,361

(22) Filed: Apr. 7, 2004

(51) Int. Cl.[7] ..... A45C 11/04
(52) U.S. Cl. ..... 206/6.1; 312/245; 312/321.5
(58) Field of Search ..... 206/6.1, 495, 566, 206/775–777; 220/212, 254.1, 254.2, 256.1; 312/204, 245, 246, 224, 308, 309, 321.5, 312/329, 351

(56) References Cited

U.S. PATENT DOCUMENTS 478,584 A * 7/1892 Fraizer ..... 312/329
4,324,446 A 4/1982 LeSage
4,413,736 A 11/1983 Nibling
4,420,084 A 12/1983 Whelan
4,502,742 A * 3/1985 Neff ..... 312/321.5
4,776,650 A 10/1988 Ferenzi
4,848,585 A 7/1989 Snyder
4,978,001 A 12/1990 Nelson
5,035,319 A * 7/1991 Kunisch ..... 206/6.1
5,141,300 A 8/1992 Ciesla
5,511,873 A * 4/1996 Mech ..... 206/6.1
6,361,130 B1 * 3/2002 Kardy ..... 312/245

* cited by examiner

*Primary Examiner*—Luan K. Bui
(74) *Attorney, Agent, or Firm*—Stephen R. Greiner

(57) ABSTRACT

A jewelry box including a cabinet with an open front and a closed back. A set of inner doors is hingedly secured within the cabinet for selectively providing access to the closed back of the cabinet. A set of outer doors is hingedly secured to the cabinet for selectively closing its open front. A number of hooks are secured to the back of the outer doors for hanging jewelry. A number of resilient strips are affixed to the front of the inner doors. The resilient strips and the inner doors are perforated for the passage of earring posts.

8 Claims, 3 Drawing Sheets

JEWELRY BOX

FIELD OF THE INVENTION

The present invention relates generally to special receptacles or packages for jewelry.

BACKGROUND OF THE INVENTION

Boxes for storing and transporting jewelry have been used for millennia. Important examples have been excavated from dozens of ancient tombs and historic sites. Most of these are simply open-topped containers within which jewelry is piled. Over time, many jewelry boxes have been improved with the addition of trays to reduce tangling of chains and other items placed inside them. Other boxes have been adapted for mounting on walls to reduce clutter on tabletops. Nevertheless, the known jewelry boxes are not capable of storing and displaying both large and small pieces of jewelry in an easily observable and accessible manner. Furthermore, the known jewelry boxes fail to provide a means for a user to check her appearance to determine whether a donned piece of jewelry looks appropriate with apparel being worn at that time.

SUMMARY OF THE INVENTION

In light of the problems associated with the known jewelry boxes, it is a principal object of the invention to provide a jewelry box within which many pieces of jewelry of varied size and design can be displayed in an organized manner that minimizes the tangling of the pieces of jewelry and facilitates the selection of a particular piece of jewelry for wear by a user.

It is another object of the invention to provide a jewelry box of the type described that permits a user to check her appearance after donning a piece of jewelry withdrawn from the jewelry box.

It is a further object of the invention to provide a jewelry box of the type described that serves a display for the favorite photographs of a user. As the jewelry box can be readily mounted on a wall or other vertical support, photographs displayed by the jewelry box can be viewed from substantial distances.

It is an object of the invention to provide improved elements and arrangements thereof in a jewelry box for the purposes described which is lightweight in construction, inexpensive to manufacture, and dependable in use.

Briefly, the jewelry box in accordance with this invention achieves the intended objects by featuring a cabinet having an open front and a closed back. A set of inner doors is hingedly secured within the cabinet for selectively providing access to the closed back thereof to which are secured a number of hooks and a mirror. A set of outer doors is hingedly secured to the cabinet for selectively closing its open front. Each of the outer doors has a panel with a recess in its front and a transparent plate affixed within the recess such that an open storage pocket is formed behind the plate and a slot is formed above the plate for access to the pocket. A number of hooks are secured to the back of the outer doors for hanging jewelry. A number of resilient strips are affixed to the front of the inner doors. The resilient strips and the inner doors are perforated for the passage of earring posts.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
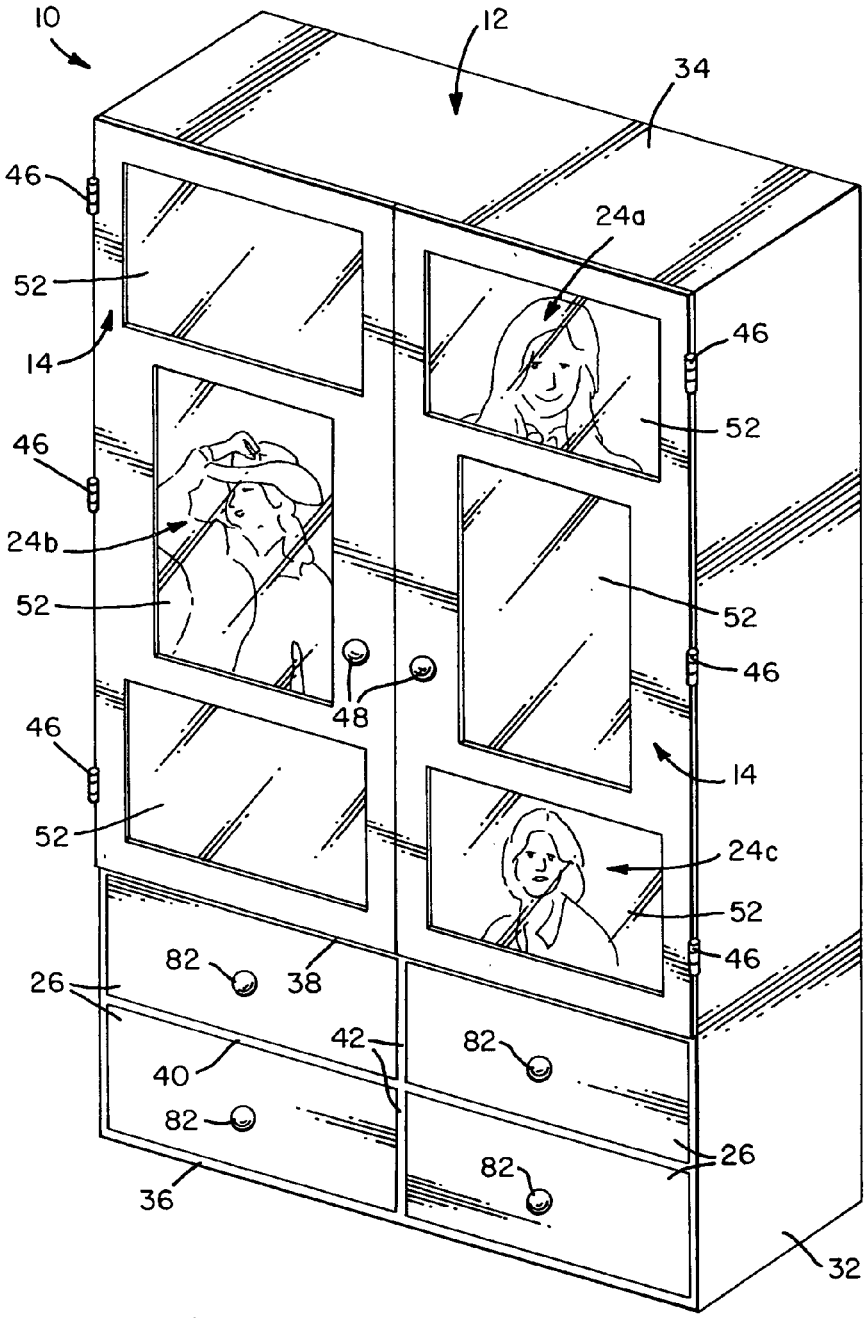
FIG. 1 is a perspective view of a jewelry box in accordance with the present invention with its outer set of doors in a closed state.
Figure 2:
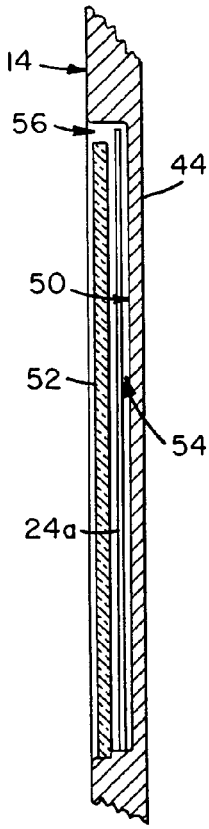
FIG. 2 is a vertical cross-sectional view of a portion of one of the outer doors of the jewelry box of FIG. 1 showing details of the photograph display feature.
Figure 3:
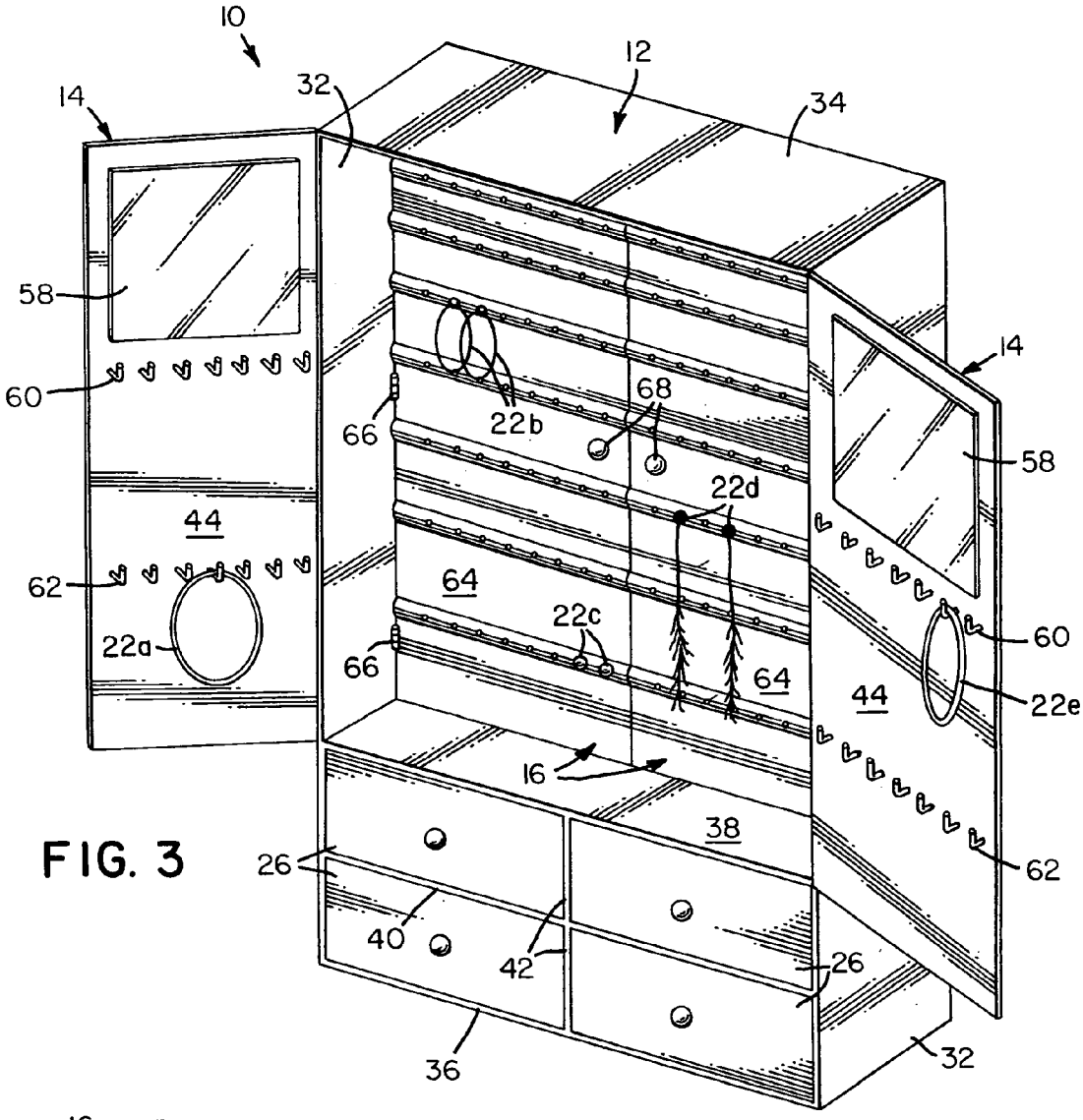
FIG. 3 is a perspective view of the jewelry box with its outer set of doors in an open state and its inner set of doors in a closed state.

Referring now to the FIGS., a jewelry box in accordance with the present invention is shown at 10. Jewelry box 10 includes a cabinet 12 with twin sets of doors 14 and 16 at its top for full access to an interior space 18 capable of storing large pieces jewelry as at 20. Doors 14 and 16 serve to display small pieces of jewelry 22*a*, 22*b*, 22*c*, 22*d* and 22*e* and photographs 24*a*, 24*b* and 24*c*. A number of drawers 26 are positioned at the bottom of cabinet 12 for retaining small keepsakes and rings 28.

Cabinet 12 includes a back wall 30 having a pair of side walls 32 extending forwardly from its opposite sides in parallel fashion. A top wall 34 projects forwardly from the top of back wall 30 and connects the tops of side walls 32 together. Also, a bottom wall 36 projects forwardly from the bottom of back wall 30 and connects the bottoms of side walls 32 together. Further, a pair of spaced-apart, intermediate walls 38 and 40 extends forwardly from back wall 30 and connects side walls 32 together at fixed locations between top wall 34 and bottom wall 36. Finally, a pair of braces 42 connects the midpoints of bottom and intermediate walls 36 and 38 forming a durable structure.

Doors 14 comprise rectangular panels 44 secured by hinges 46 to the fronts of side walls 32. Each panel 44 is provided with a knob 48 on its front for opening and closing it. Adjacent knob 48, each panel 44 has a number of rectangular recesses 50 in its front. A transparent plate 52 is affixed about its own bottom and sides to the front of each recess 50 so that an open storage pocket 54 is formed behind the plate 52. A slot or gap 56 is provided between the top of each recess 50 and each plate 52 to serve as an accessway to each storage pocket 54. If desired, a user of jewelry box 10 can slide a photograph such as 24*a*, 24*b* or 24*c* through a slot 56 into a storage pocket 54 for convenient display.

Affixed to the back of each door 14 are a mirror 58 and a number of hooks 60 and 62. As shown, each mirror 58 is positioned at the top of a panel 44 so that the maximum amount of ambient light is reflected toward interior space 18 when doors 14 are open. Hooks 60 and 62, on the other hand, are arranged in a pair of rows, one above the other, beneath mirror 58. Upon either hooks 60 or 62 can be suspended pieces of jewelry like bracelet 22*a*.

Figure 4:
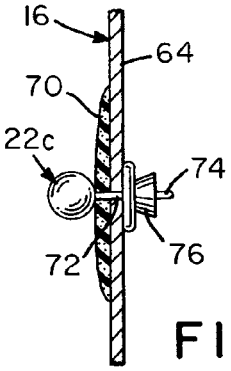
FIG. 4 is a vertical cross-sectional view of a portion of one of the inner doors of the jewelry box showing details of the earring-retaining feature.
Figure 5:
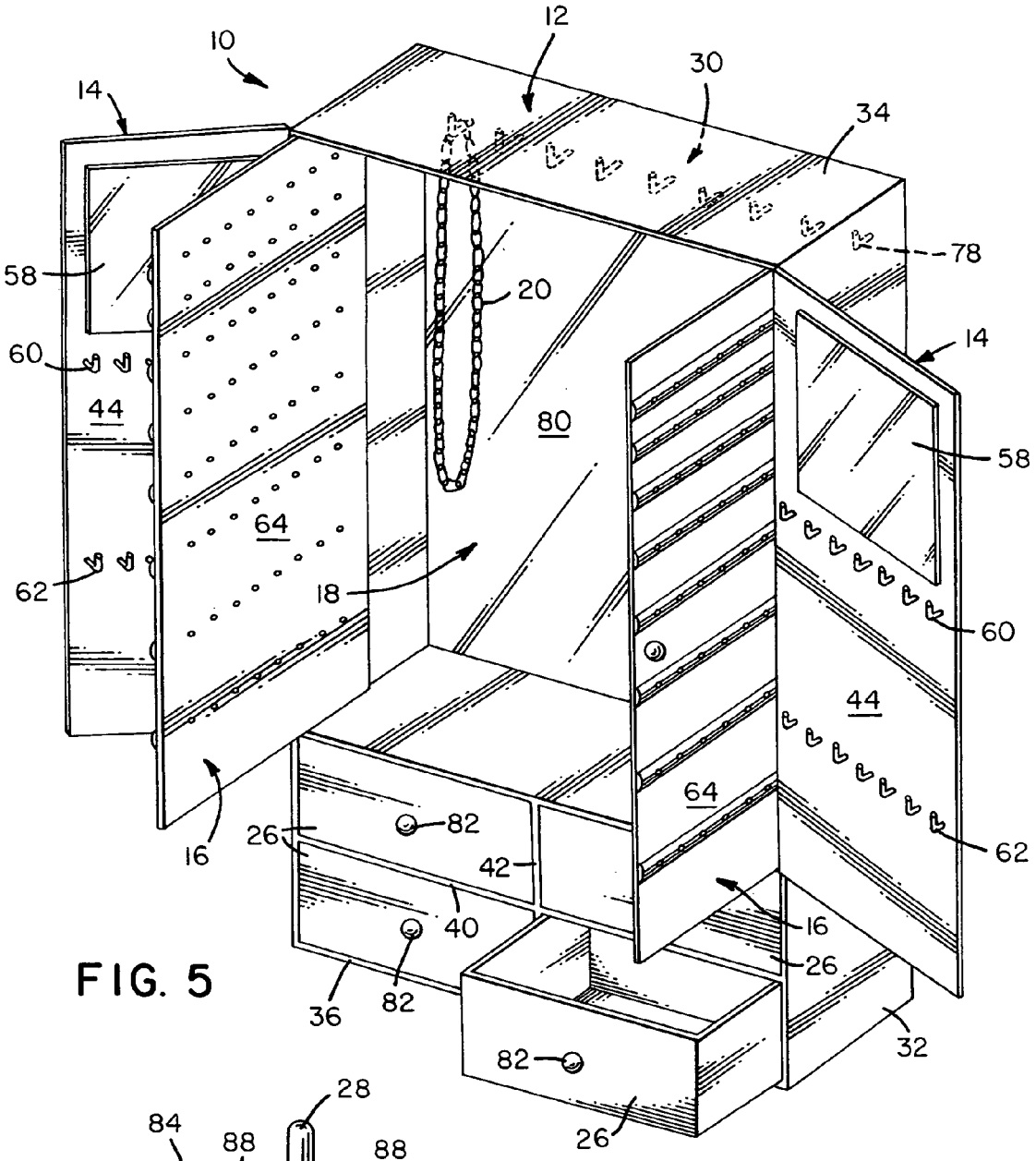
FIG. 5 is a perspective view of the jewelry box with both its outer and inner sets of doors in an open state.
Figure 6:
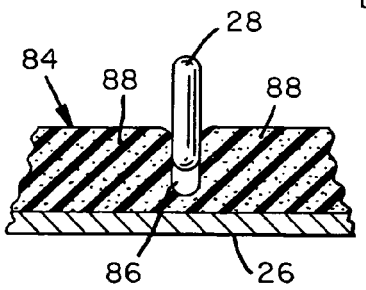
FIG. 6 is a vertical cross-sectional view of a portion of one of the drawers of the jewelry box showing details of the ring tray feature.

Doors 16 comprise rectangular panels 64 secured by hinges 66 to side walls 32 midway between back wall 30 and doors 14. A knob 68 is secured to the front of each panel 64. Above and below the knob 68, each panel 64 carries a number of resilient strips 70 that are more closely spaced at the top of panel 64 than at the bottom to accommodate jewelry of different sizes. Strips 70 are perforated along their lengths by spaced apart holes 72 that also fully penetrate panels 64. Holes 72 permit the passage of the posts 74 of pierced earrings 22*c* to receive a clasp 76. When an earring 22*c* is carried by a door 16 as shown in FIG. 4, strip 70 minimizes the rattling of earring 22*c* as door 16 is opened and, also, provides a light backpressure to clasp 76. The backpressure locks clasp 76 on post 74 and minimizing the likelihood of earring 22*c* becoming detached from door 16 and lost.

Affixed to the top of back wall 30 within interior space 18 is a row of spaced-apart hooks 78. Upon hooks 78 can be suspended large pieces of jewelry like a necklace 20.

Beneath hooks 78, a mirror 80 is affixed to back wall 30. Mirror 80 is substantially coextensive with back wall 30 above intermediate wall 38 and permits a user to easily model jewelry for herself before venturing away from jewelry box 10. Of course, when necklace 20 is suspended from a hook 78, a dazzling display is presented to a viewer as its features are doubled in the mirror 80.

Drawers 26 are slidably fitted in the bottom of cabinet 12. Knobs 82 on the front of drawers 26 permit such to be withdrawn from cabinet 12 for easy access to their contents that may include small items like a ring 28. To conveniently store a multitude of rings 28, a ring tray 84 can be fitted within one, or more, of drawers 26. Tray 84 includes a series of snug troughs 86 formed between pads 88 that releasably grip rings and prevent them from sliding about.

Although jewelry box 10 can be used as a free-standing unit, most users will probably mount it, with conventional hardware, upon a wall or other vertical support for use. Wall mounting offers the benefits of placing jewelry close to eye level for viewing that cannot typically be provided by setting jewelry box 10 on a table. A user of jewelry box 10 can find and select jewelry suspended from hooks 60, 62 and 78 or positioned in drawers 26 in a matter of seconds and determine, with a glance in one of mirrors 58 or 80, whether it is appropriate for wear on a particular occasion.

While jewelry box 10 has been described with a high degree of particularity, it will be appreciated by those skilled in the art that modifications may be made thereto. Therefore, it is to be understood that the present invention is not limited to the sole jewelry box embodiment described above, but encompasses any and all embodiments within the scope of the following claims.

I claim:

1. A jewelry box, comprising:

a cabinet having an open front and a closed back;

a set of inner doors being hingedly secured within said cabinet for selectively providing access to said closed back thereof;

a set of outer doors being hingedly secured to said cabinet for selectively closing said open front thereof;

a plurality of hooks being secured to the back of said outer doors for hanging jewelry thereon; and, a plurality of resilient strips being affixed to the front of said inner doors, said resilient strips and said inner doors being perforated for the passage of earring posts.

2. The jewelry box according to claim 1 further comprising a first pair of mirrors each being secured to the back side of a respective one of said outer doors.

3. The jewelry box according to claim 2 further comprising a second mirror being positioned across said closed back of said cabinet.

4. The jewelry box according to claim 1 further comprising a plurality of drawers slidably engaged with the bottom of said cabinet.

5. The jewelry box according to claim 4 further comprising a tray positioned within said drawer including a pair of resilient pads between which is formed a jewelry-receiving trough.

6. The jewelry box according to claim 1 wherein each of said outer doors comprises:

a rectangular panel being hingedly secured to said cabinet, said panel having a recess in the front thereof; and, a transparent plate being affixed about its bottom and sides to the front of said recess so that an open storage pocket is formed behind said transparent plate, a slot being provided between the top of said recess and said transparent plate serving as an accessway to said storage pocket.

7. A jewelry box, comprising:

a cabinet having an open front and a closed back;

a set of inner doors being hingedly secured within said cabinet for selectively providing access to said closed back thereof;

a set of outer doors being hingedly secured to said cabinet for selectively closing said open front thereof, each of said outer doors including:

a panel being hingedly secured to said cabinet, said panel having a recess in the front thereof; and, a transparent plate being affixed about its bottom and sides to the front of said recess so that an open storage pocket is formed behind said transparent plate, a slot being provided between the top of said recess and said transparent plate serving as an accessway to said storage pocket;

a plurality of hooks being secured to the back of said outer doors for hanging jewelry thereon;

a plurality of resilient strips being affixed to the front of said inner doors, said resilient strips and said inner doors being perforated for the passage of earring posts; and, a plurality of drawers being slidably engaged with the bottom of said cabinet.

8. The jewelry box according to claim 7 further comprising:

a second plurality of hooks being secured to said closed back of said cabinet; and, a mirror being secured to said closed back of said cabinet.

* * * * *